United States Patent [19]

Hata

[11] Patent Number: 4,520,536

[45] Date of Patent: Jun. 4, 1985

[54] CLOTHING CLASP

[76] Inventor: Hiroyuki Hata, 5-8-19 Morikita-cho, Higashinada-ku, Kobe 658, Japan

[21] Appl. No.: 502,200

[22] Filed: Jun. 8, 1983

[30] Foreign Application Priority Data

Jun. 17, 1982 [JP] Japan ..... 57-91363[U]

[51] Int. Cl.[3] ..... A44B 21/00

[52] U.S. Cl. ..... 24/498; 2/70; 2/320; 24/517; 24/522; 24/523

[58] Field of Search ..... 24/67.11, 170, 489, 24/490, 498, 517, 523, 645, 67.3, 67.5, 67.7, 492, 505, 522; 2/320, 70; 269/254 CS, 238

[56] References Cited

U.S. PATENT DOCUMENTS

| | | | |
|---|---|---|---|
| 716,472 | 12/1902 | Pilcher | 24/498 |
| 768,037 | 8/1904 | Fearns | 2/320 X |
| 848,732 | 4/1907 | Eisman | 24/498 X |
| 1,275,582 | 8/1918 | Mascellino | 24/498 X |
| 1,768,596 | 7/1930 | Gowen | 24/170 X |
| 1,944,603 | 1/1934 | Hecker | 24/523 X |
| 2,605,924 | 8/1952 | Green | 24/498 X |
| 2,864,361 | 12/1958 | Johnson | 24/645 X |
| 2,916,786 | 12/1959 | Legat | 24/170 |
| 3,120,046 | 2/1964 | Olsen | 24/498 |
| 3,413,691 | 12/1968 | Elsner | 24/170 |

*Primary Examiner*—William E. Lyddane
*Assistant Examiner*—James R. Brittain
*Attorney, Agent, or Firm*—Marshall, O'Toole, Gerstein, Murray & Bicknell

[57] ABSTRACT

This disclosure relates to a clamper for holding articles of clothing together, and comprises a front member, a clamp member, and pivot means for connecting the members together and for holding the clamp member at a space from the front member; the members are adapted to be positioned such that portions of the articles of clothing are received in the space; the clamp member is movable on the pivot means between a clamped position and an open position, and the clamp member includes an article engagement part thereon. The engagement part extends into the space when the clamp member is in the clamped position and it is moved out of the space when said clamp member is pivoted to the open position.

9 Claims, 7 Drawing Figures

FIG. 1
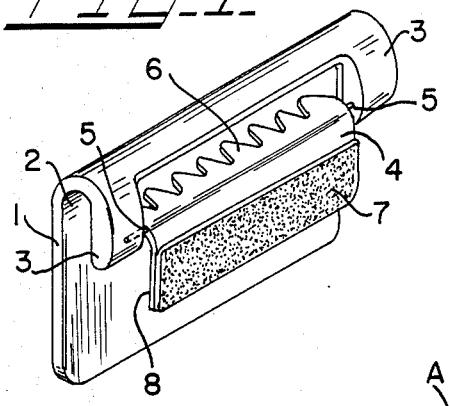
FIG. 4
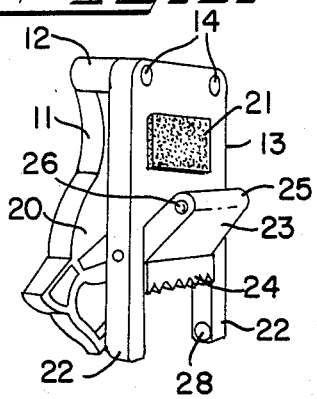
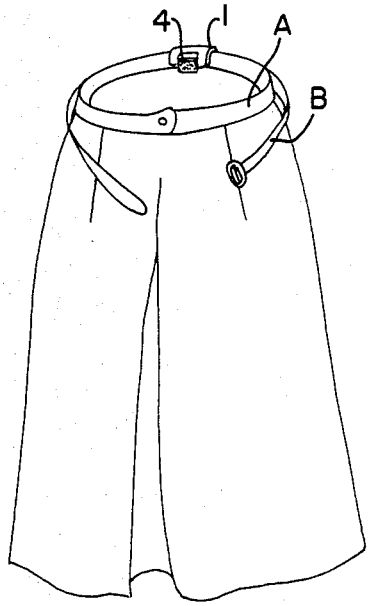
FIG. 2
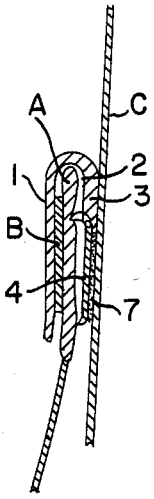
FIG. 3
FIG. 7
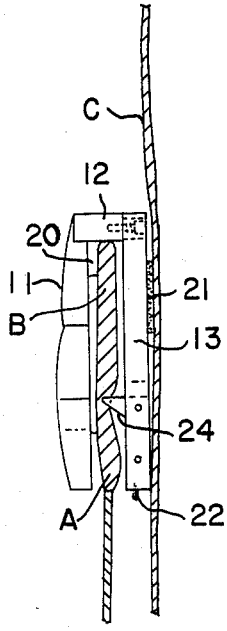
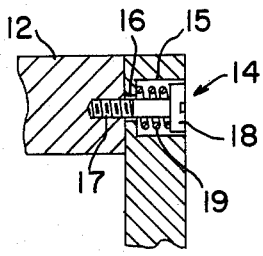
FIG. 5
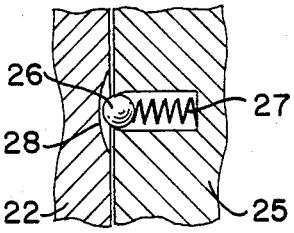
FIG. 6

CLOTHING CLASP

This invention relates to ornamental apparatus for fastening clothes or the like in place while being worn.

When an article of clothing such as a skirt or pants that does not have belt loops is worn with a waist belt, the belt may awkwardly shift from the desired position as the wearer moves about. On the other hand, when a blouse or the upper piece of a two-piece outfit is worn with a skirt, or with the lower piece over the lower portion of the upper piece, the lower portion may be pulled out and the upper piece may give a disheveled appearance.

It is a general object of this invention to prevent the foregoing disadvantages by providing apparatus for clamping together clothes and a waist belt, or for clamping two or more pieces of clothing together.

It is another object of the invention to provide such apparatus, which is also adapted to hold the lower portion of the upper piece of a two-piece outfit under the lower piece.

The foregoing objects are attained by providing apparatus in accordance with this invention, comprising a front plate member, means on said plate member forming a loop that is adapted to receive portions of articles of clothing, and a back part pivotably attached to said plate part and adapted, when pivoted to a clamped position, to secure said members to said clothing portions. One of the articles preferably comprises a belt positioned in said loop and secured to the upper edge of a skirt. The back part may include high friction means for engaging and holding another article of clothing such as a blouse.

Preferred embodiments of the invention are shown in the accompanying drawings, wherein:

FIG. 1 is a perspective view of apparatus according to a first embodiment of the invention;

FIG. 2 is a perspective view showing the apparatus attached to articles of clothing;

FIG. 3 is an enlarged sectional view showing the apparatus of FIG. 1;

FIG. 4 is a perspective view of apparatus according to a second embodiment of the invention;

FIGS. 5 and 6 are enlarged sectional views of parts of the apparatus shown in FIG. 4; and FIG. 7 is a side view of the apparatus shown in FIG. 4, attached to articles of clothing.

With reference to FIG. 1, the clasp includes a front plate 1 having a top turn or loop that forms a pair of downward extensions 3 at its opposite ends, a space 2 being formed between the backside of the plate 1 and the extensions 3. The plate 1 may be ornamented in any desired manner, and it is preferably lightweight.

An angle-shaped flap 4 is pivotably supported on a pin or shaft 5, and bridges the extensions 3. The flap 4 has teeth 6 formed on the outer edge of one arm, and the other arm forms a plate part 8 that is at an angle to the teeth 6. The shaft 5 is at the junction of the two arms so that, when the part 8 is in a downward position generally parallel to the front plate 1, as shown in FIG. 1, the teeth 6 are directed inwardly into the space 2.

The plate part 8 has an anti-slip material or surface 7 provided on its outer side, and the surface 7 may be formed by a rough metal surface or a high friction member such as rubber adhered to the flap 4.

The use of the clasp is shown in FIGS. 2 and 3. To attach the clasp, the flap 4 of the clamper is turned to direct the teeth 6 downwardly parallel to the front plate 1 and out of the space 2. The clasp is then attached to a skirt by positioning the upper end A of the skirt and a waist belt B placed around the upper end A within the space 2. The flap 4 is then turned downwardly to the position shown in FIG. 3 wherein the teeth 6 bite the upper end A to clamp the skirt and belt against the front plate 1.

As shown in FIG. 3, the non-slip surface 7 engages the lower end of a blouse C and holds it tucked into the skirt as the wearer moves about.

The front plate 1 could also be provided with means (not shown) adapted to fasten the plate 1 to the belt B.

The second embodiment of the invention is shown in FIGS. 4–7, wherein the clasp includes an ornamental front plate 11 (FIGS. 4 and 7) having two spacer members 12 extending rearwardly from its top end. A back plate 13 has bores 14 formed therethrough adjacent its top end. As best shown in FIG. 5, each bore 14 has an enlarged outer portion 15 and a reduced inner portion 16 of a smaller diameter.

A bolt 17 having a head 18 extends through each bore 14 and is threaded into the rear edge of a spacer member 12. A compression spring 19 is provided around the bolt 17 within the larger-diameter portion 15 of bore 14, in order to urge the back plate 13 toward the front plate 11, with a space 20 being formed between the plates 11 and 13. This allows the clasp to accommodate to various thicknesses of clothing or belts received in the space 20 because the back plate can move rearwardly against the force of the springs 19 to receive a large thickness.

The back plate 13 preferably has a non-slip surface 21 provided on its outer or back side, and it includes a pair of spaced downwardly extensions 22 at its opposite ends. Pivotably supported between the extensions 22 is an angular flap or clamp member 23, which has teeth 24 and a plate part 25 at an angle to the teeth 24.

As shown in FIG. 6, a ball-and-detent arrangement is provided to retain the back plate 13 in the clamped position shown in FIG. 7. The plate part 25 has a ball 26 in a hole, urged by a spring 27 to partially project from each of its side edges. Reduced diameter lips are formed at the mouth of the hole in order to retain the ball in the hole. Each extension 22 of the back plate 13 has a detent or recess 28 in its inner side for snap engagement with the adjacent ball 26 to hold the teeth 24 within the space 20 (FIG. 7).

I claim:

1. A clasp for holding articles of clothing together, comprising a front member, a back member, detachable fastening means for attaching said back member to said front member at spaced locations to define a space therebetween, said fastening means being releasable to enable said back member to be detached from said front member, and said fastening means including resilient means enabling said back member to move relative to said front member and to urge said back member toward said front member, a clamp member, pivot means connecting said back and clamp members together, said front and back members being adapted to be positioned such that portions of said articles of clothing are received in said space, said clamp member being movable on said pivot means between a clamped position and an open position, said clamp member including article engagement means thereon, said engagement means extending into said space when said clamp member is in said clamped position and being out of said space when said clamp member is in said open position.

2. A clasp according to claim 1, wherein one of said clamp and back members has high friction means provided on its outer side which is opposite to said space.

3. A clasp according to claim 2, wherein said high friction means is on said back member.

4. A clasp according to claim 1, wherein said engagement means comprises a plurality of teeth formed on an edge of said clamp member.

5. A clasp according to claim 1, and further including means connecting said back and clamp members when said clamp member is in said clamped position for holding said clamp member in said clamped position.

6. A clasp according to claim 1, wherein said detachable fastening means comprises a screw having a head, said screw extending through said back member and threading into said front member and said head appearing at said back member.

7. A clasp comprising a front member, a rear member extending generally parallel to said front member at a space therefrom, detachable fastening means including spring means connecting said rear member to said front member and spring-urging said rear member toward said front member, said rear member having means forming an antislip surface on its outer side, said rear member further including a pair of extensions, a clamp member pivotably supported on an axis between said extensions, said clamp member including engagement means movable into said space, said clamp member further having a plate portion that extends at an angle to said engagement means whereby when said engagement means are in said space, said plate portion is adjacent said extensions, and holding means provided between said plate portion and said extensions for holding said engagement means in said space.

8. A clasp according to claim 7, wherein said engagement means comprises a plurality of teeth.

9. A clasp according to claim 7, wherein said detachable fastening means comprises a screw having a head, said screw extending through said rear member and threading into said front member and said head appearing at said rear member.

* * * * *